United States Patent [19]

Withrow

[11] 4,181,250

[45] Jan. 1, 1980

[54] NEWSPAPER TUBE CLOSURE

[76] Inventor: Virdean N. Withrow, R.R. #1, Granville, Ill. 61326

[21] Appl. No.: 963,923

[22] Filed: Nov. 24, 1978

[51] Int. Cl.[2] ..... A47G 29/12

[52] U.S. Cl. ..... 232/44; 232/1 C; 232/45

[58] Field of Search ..... 232/1 C, 17, 34, 35, 232/45, 44

[56] References Cited

U.S. PATENT DOCUMENTS

| | | | |
|---|---|---|---|
| 2,845,217 | 7/1958 | Jacques | 232/17 X |
| 2,927,726 | 3/1960 | Workman | 232/1 C X |
| 3,086,674 | 4/1963 | Scheuerman | 232/1 C X |
| 3,144,984 | 8/1964 | Ross | 232/1 C |
| 3,888,409 | 6/1975 | Bolduc | 232/1 C |
| 4,007,870 | 2/1977 | Hankis | 232/1 C X |

*Primary Examiner*—Ramon S. Britts
*Assistant Examiner*—Peter A. Aschenbrenner
*Attorney, Agent, or Firm*—Daniel J. Tick

[57] ABSTRACT

An inner door is pivotally mounted adjacent one of the sides of a newspaper tube in the newspaper tube at a predetermined distance from the open mouth thereof and is rotatable perpendicularly to the top and bottom of the tube. A spring-biased device abuts the inner door and urges it to its closed position perpendicular to the sides of the tube. An outer door is pivotally mounted adjacent the top of the newspaper tube adjacent the open mouth of the tube between the inner door and the open mouth and is rotatable perpendicularly to the sides of the tube. The outer door is restrained in its open position by a lip extending perpendicularly from an edge of the inner door adjacent and parallel to the top of the tube and extending toward the open mouth of the tube. The lip of the inner door abuts the outer surface of the outer door in the area of the top edge of the outer door when the inner door is closed. The outer door is released to pivot to its closed position by the removal of the lip from the outer door when the inner door is in its open position at which time the outer door closes the newspaper tube in a weatherproof condition.

2 Claims, 3 Drawing Figures

NEWSPAPER TUBE CLOSURE

BACKGROUND OF THE INVENTION

The present invention relates to a newspaper tube closure. More particularly, the invention relates to a mail box adapter for a newspaper tube of substantially rectangular parallelepiped configuration having a bottom, a top spaced from and substantially parallel to the bottom and a pair of spaced substantially parallel sides joining the top and bottom and substantially perpendicular thereto. The newspaper tube has an open mouth.

Newspaper tube closures of the type disclosed herein are described in the following United States patents. U.S. Pat. No. 2,120,857, issued June 14, 1938 to Crawford et al., U.S. Pat. No. 2,496,962, issued Feb. 7, 1950 to Shaw, U.S. Pat. No. 2,519,525, issued Aug. 22, 1950 to White, U.S. Pat. No. 3,042,293, issued July 3, 1962 to Miller, U.S. Pat. No. 4,002,291, issued Jan. 11, 1977 to Hodge and U.S. Pat. No. 4,026,461, issued May 31, 1977 to Hodge.

Objects of the invention are to provide a newspaper tube closure or mail box adapter of simple structure, which is inexpensive in manufacture, installed in most newspaper tubes or mail boxes with facility and convenience, and functions efficiently, effectively and reliably to close a newspaper tube or mail box in weatherproof condition when a newspaper or similar parcel is placed in the tube or box thereby preventing the destruction of the newspaper or parcel by rain and/or wind due to adverse weather conditions. The closure or adapter of the invention is especially useful as a newspaper tube and keeps a newspaper dry and intact.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
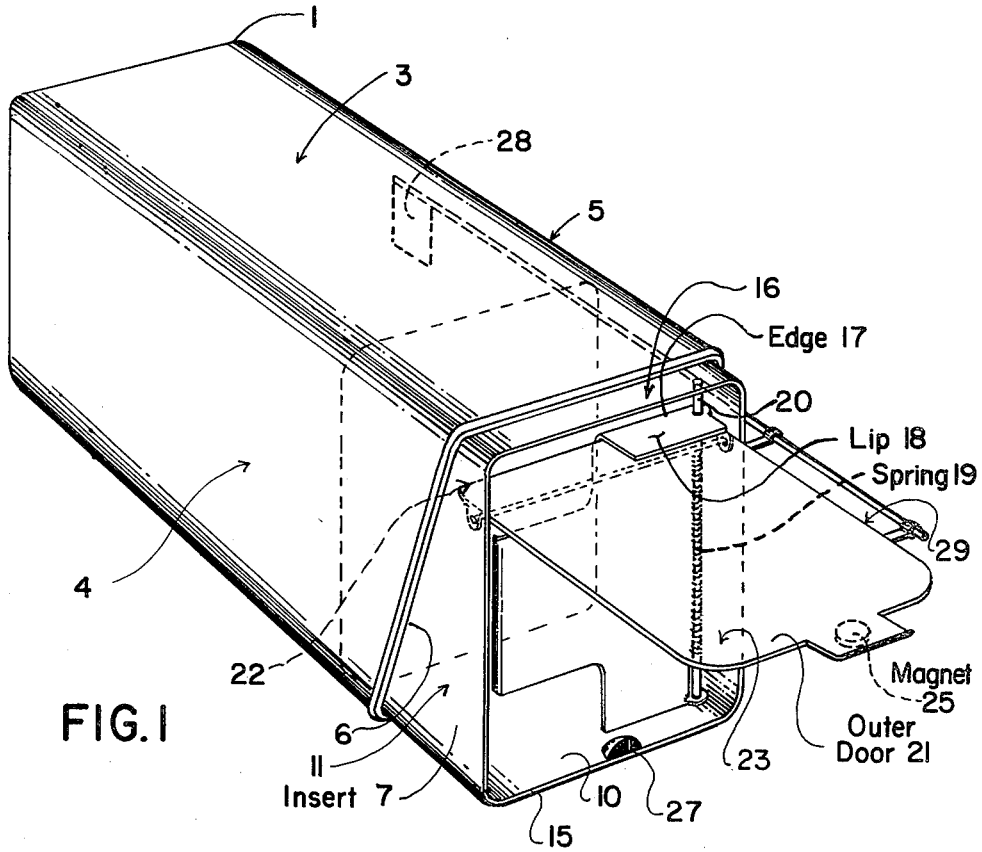
FIG. 1 is a perspective view of an embodiment of the newspaper tube closure of the invention installed in a newspaper tube.
Figure 2:
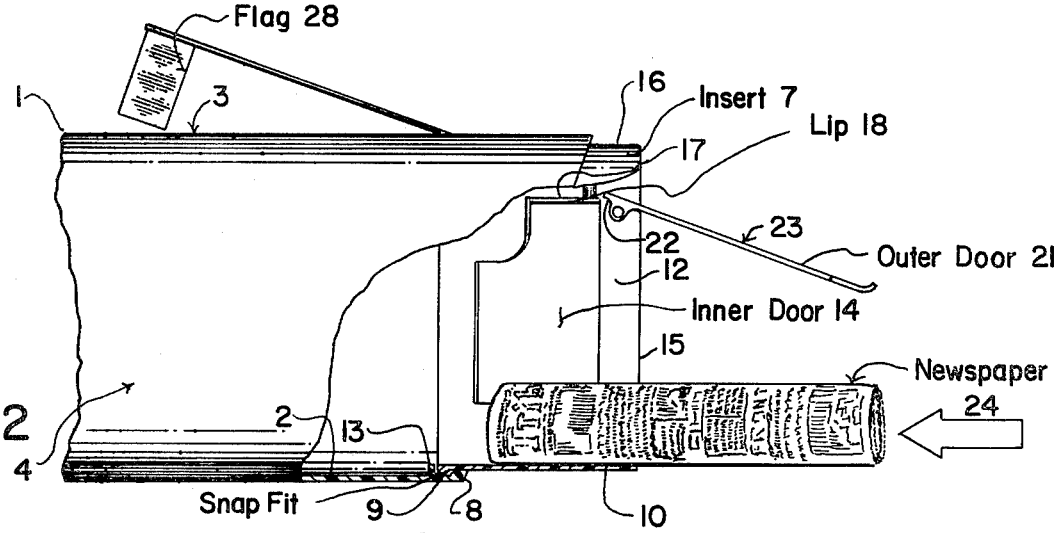
FIG. 2 is a view, partly cutaway and partly in section, of the embodiment of FIG. 1, illustrating the mounting of the newspaper tube closure of the invention in a newspaper tube.

The newspaper tube closure of the invention is for a newspaper tube or mail box 1 of substantially rectangular parallelepiped configuration, as shown in FIGS. 1 and 2. The newspaper tube or mail box has a bottom 2 (FIG. 2), a top 3 (FIGS. 1 and 2) spaced from and substantially parallel to the bottom, and a pair of spaced substantially parallel sides 4 and 5 (FIG. 1) joining the top and bottom and substantially perpendicular thereto. The newspaper tube or mail box 1 has an open mouth 6 (FIG. 1).

Figure 3:
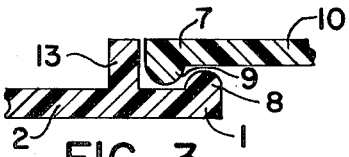
FIG. 3 is a view, on an enlarged scale, in section, illustrating the snap fit of the newspaper tube closure of the invention in a newspaper tube.

The newspaper tube closure of the invention comprises a sleeve insert 7 snugly positioned in the mail box 1 at the mouth end thereof and snapped in position via a projecting lip 8 (FIGS. 2 and 3) extending along the bottom 2 of the box 1, perpendicularly to the sides 4 and 5 of said box and a downwardly projecting lip 9 extending from the bottom 10 of the insert 7, as shown in FIGS. 2 and 3, perpendicularly to the sides 11 and 12 of said insert. The projecting lip 9 is resiliently forced into the space between the projecting lip 8 and a projecting portion 13 extending upward from the bottom 2 of the closure or box 1 and is retained in such position, thereby retaining the insert 7 in the box 1, until the exertion of a great manual force removes said insert from said closure or box.

An inner door 14 (FIGS. 1 and 2) is pivotally mounted adjacent the side 12 of the insert 7 and the side 5 of the mail box 1, as shown in FIGS. 1 and 2, at a predetermined distance D (FIG. 2) from the open mouth 15 of the insert 7 (FIGS. 1 and 2). The inner door 14 is mounted for rotation perpendicularly to the top 16 of the insert 7 and the top 3 of the newspaper tube or mail box 1 as well as to the bottom 10 of said insert and the bottom 2 of said newspaper tube or mail box.

The inner door 14 rotates from a closed position substantially perpendicular to the top, bottom and sides 16, 10, 11 and 12, respectively, of the insert 7 and the top, bottom and sides 3, 2, 4 and 5, respectively, of the newspaper tube or mail box 1, to an open position, shown in FIG. 2, at an angle between approximately 90° and 0° with the side 12 or 5. The inner door 14 has an edge 17 (FIGS. 1 and 2) adjacent and parallel to the top 16 of the insert 7 and the top 3 of the newspaper tube or mail box 1. A lip 18 (FIGS. 1 and 2) extends substantially perpendicularly from the edge 17 of the inner door 14 toward the open mouth 10 of the insert 7.

A spring 19 (FIG. 1) is wound around the pivot rod 20 of the inner door 14 and abuts said inner door and urges it to its closed position, as shown in FIG. 1.

An outer door 21 (FIGS. 1 and 2) is pivotally mounted adjacent the top 16 of the insert 7 and the top 3 of the newspaper tube or mail box 1, adjacent the open mouth 10 of said insert between the inner door 14 and said open mouth. The outer door 21 is mounted for rotation perpendicularly to the sides 11 and 12 of the insert 7 and the sides 4 and 5 of the newspaper tube or mail box 1 from an open position, shown in FIG. 1, substantially parallel to the top and bottom 16 and 10, respectively, of the insert 7 and the top and bottom 3 and 2, respectively, of the newspaper tube or mail box 1, to a closed position (not shown in the FIGS.) substantially perpendicular to the top, bottom and sides 16, 10, 11 and 12, respectively, of the insert 7 and the top, bottom and sides 3, 2, 4 and 5, respectively, of the newspaper tube or mail box 1.

The outer door 21 has a top edge 22 (FIGS. 1 and 2) adjacent and parallel to the top 16 of the insert 7 and the top 3 of the newspaper tube or mail box 1 and an outer surface 23 (FIGS. 1 and 2) facing the open mouth 15 of the insert 7. The outer door 21 is restrained in its open position, shown in FIG. 1, by the lip 18 of the inner door 14 abutting the outer surface 23 of said outer door in the area of the top edge 22 of said outer door when said inner door is in its closed position, as shown in FIG. 1. The outer door 21 is released, to pivot to its closed position by the removal of the lip 18 from said outer door when the inner door 14 is in its open position, shown in FIG. 2, whereby the outer door closes the newspaper tube or mail box 1 in a weatherproof condition.

Thus, when a newspaper 24, or other parcel is inserted into the newspaper tube or mail box 1 via the insert 7, as shown in FIG. 2, said newspaper opens the inner door 14, thereby releasing the outer door 21 so that when the newspaper is fully inserted in the tube or box, said outer door seals the tube or box in a weatherproof condition thereby preventing rain or wind damage to the newspaper or other parcel.

The inner and outer doors 14 and 21 may be mounted directly in the newspaper tube or mail box 1, rather than in an insert, as described. The function of the insert 7 is to permit the conversion of existing newspaper tubes or mail boxes.

A magnet 25 (FIG. 1) is provided on the inside surface 26 (FIG. 2) of the outer door 21 and is attracted to a metal projection 27 at the open mouth 15 of the insert 7 to maintain said outer door closed. The projection 27 is mounted on the inside of the bottom 10 of the insert 7.

A flag 28 is affixed to the side edge 29 (FIG. 1) of the outer door 21 (FIG. 1) outside the insert 7 and the tube or box 1 and extends beyond the top edge 22 of said outer door, so that when said outer door is closed, the flag is up, thereby indicating from a distance that a parcel has been placed in the tube or box.

A modified version of the adapter of the invention is a conical adapter releasably affixed, via snap fit, to a cylindrical newspaper tube or mail box.

While the invention has been described by means of a specific example and in a specific embodiment, I do not wish to be limited thereto, for obvious modifications will occur to those skilled in the art without departing from the spirit and scope of the invention.

I claim:

1. A newspaper tube closure for a newspaper tube of substantially rectangular parallelepiped configuration having a bottom, a top spaced from and substantially parallel to the bottom and a pair of spaced substantially parallel sides joining the top and bottom and substantially perpendicular thereto, said newspaper tube having an open mouth, said newspaper tube closure comprising an inner door pivotally mounted adjacent one of the sides of the newspaper tube at a predetermined distance from the open mouth thereof, said inner door being mounted for rotation perpendicularly to the top and bottom of said newspaper tube from a closed position substantially perpendicular to said top, bottom and sides of said newspaper tube to an open position at an angle between approximately 90° and 0° with said one of said sides, said inner door having an edge adjacent and parallel to said top of said newspaper tube and a lip extending substantially perpendicularly from said edge toward said open mouth of said newspaper tube;

spring biasing means abutting said inner door and urging it to its closed position;

an outer door pivotally mounted adjacent said top of said newspaper tube adjacent said open mouth of said newspaper tube between said inner door and said open mouth, said outer door being mounted for rotation perpendicularly to said sides of said newspaper tube from an open position substantially parallel to said top and bottom of said newspaper tube to a closed position substantially perpendicular to said top, bottom and sides of said newspaper tube, said outer door having a top edge adjacent and parallel to the top of said newspaper tube and an outer surface facing said open mouth of said newspaper tube and being restrained in its open position by the lip of said inner door abutting the outer surface of said outer door in the area of the top edge of said outer door when said inner door is in its closed position and being released to pivot to its closed position by the removal of said lip from said outer door when said inner door is in its open position whereby said outer door closes said newspaper tube in a weatherproof condition.

2. A newspaper tube closure as claimed in claim 1, further comprising a sleeve insert snugly fittable in the newspaper tube at the open mouth thereof, fastening means affixed to the newspaper tube and the insert for releasably securing said insert in said newspaper tube with part of said insert extending into said newspaper tube and part of said insert extending out of said newspaper tube, said insert having a top next-adjacent the top of the newspaper tube, a bottom next-adjacent the bottom of said newspaper tube, and sides next-adjacent the sides of said newspaper tube when secured in position by said fastening means, and wherein said inner and outer doors are mounted in said insert in the area of the open mouth thereof.

* * * * *